US006682257B1

(12) United States Patent
Zappe

(10) Patent No.: US 6,682,257 B1
(45) Date of Patent: Jan. 27, 2004

(54) COVER APPARATUS FOR AN ACCESS OPENING

(76) Inventor: Raymond Zappe, 4609 E. Desert View Dr., Phoenix, AZ (US) 85044

( * ) Notice: Subject to any disclaimer, the term of this patent is extended or adjusted under 35 U.S.C. 154(b) by 0 days.

(21) Appl. No.: 10/091,511

(22) Filed: Mar. 7, 2002

(51) Int. Cl.[7] ..... E02D 29/14
(52) U.S. Cl. ..... 404/25
(58) Field of Search ..... 404/25, 26

(56) References Cited

U.S. PATENT DOCUMENTS 1,852,928 A * 4/1932 Helling ..... 404/26
2,559,564 A * 7/1951 Sperling ..... 220/232
3,294,000 A * 12/1966 Pelsue ..... 404/26
4,050,839 A * 9/1977 Vollmar ..... 404/72
4,373,381 A * 2/1983 Kulp et al. ..... 73/40.5 R
4,523,407 A * 6/1985 Miller ..... 49/465
5,046,886 A * 9/1991 Muir et al. ..... 404/25
5,052,851 A * 10/1991 Frishauf ..... 404/25
5,217,052 A * 6/1993 Sharp ..... 141/86
5,240,346 A * 8/1993 Yin ..... 404/25
5,275,501 A * 1/1994 Amorese et al. ..... 404/25
5,366,317 A * 11/1994 Solimar ..... 404/25
5,482,400 A * 1/1996 Bavington ..... 404/25
6,109,824 A * 8/2000 Annes ..... 404/26

* cited by examiner

*Primary Examiner*—Robert E. Pezzuto
*Assistant Examiner*—Raymond W Addie
(74) *Attorney, Agent, or Firm*—H. Gordon Shields

(57) ABSTRACT

A cover apparatus for temporarily covering access openings for water, drain, manhole and overflow pipes during construction, when the access openings are exposed, to prevent dirt, dust or unauthorized access to the access openings. The cover apparatus includes a top portion which extends beyond the access opening, a depending side wall which fits within the access opening, a outwardly flared lower side wall which extends below the depending side wall, a central ring depending from the top portion in spaced relation from the depending side wall, and a plurality of ribs extending between the central ring and the depending side wall. A pump means is secured within the central ring, and an expandable bladder in fluid communication with the pump means is positioned on the depending side wall, between the top portion and the outwardly flared side wall. When inflated, the expandable bladder seals the cover apparatus to the access opening. An annular ring may be used to position the expandable bladder on the depending side wall between the annular ring and the outwardly flared side wall.

20 Claims, 3 Drawing Sheets

FIG. 4.
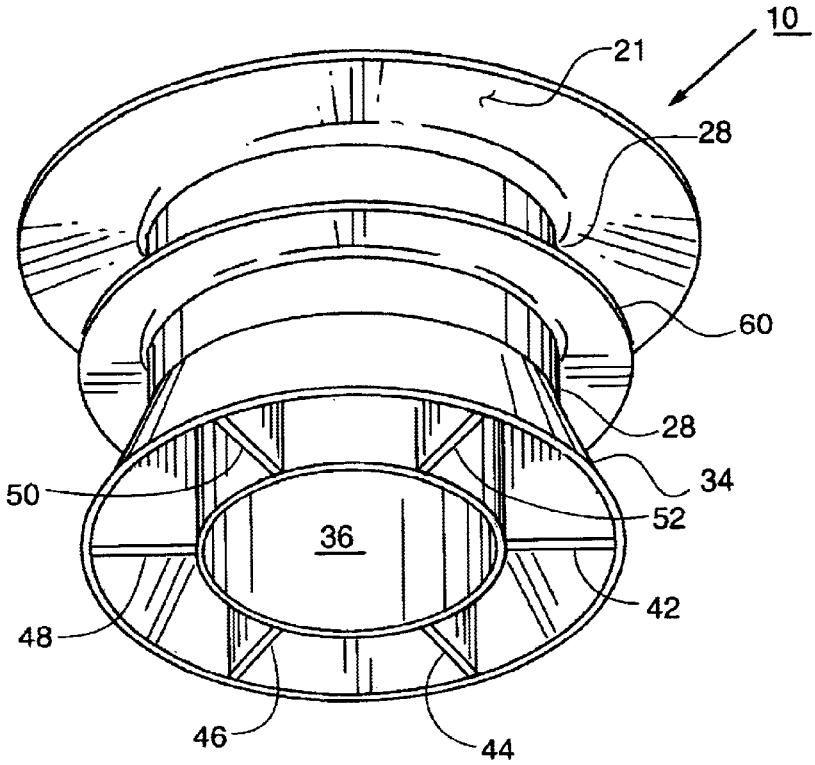
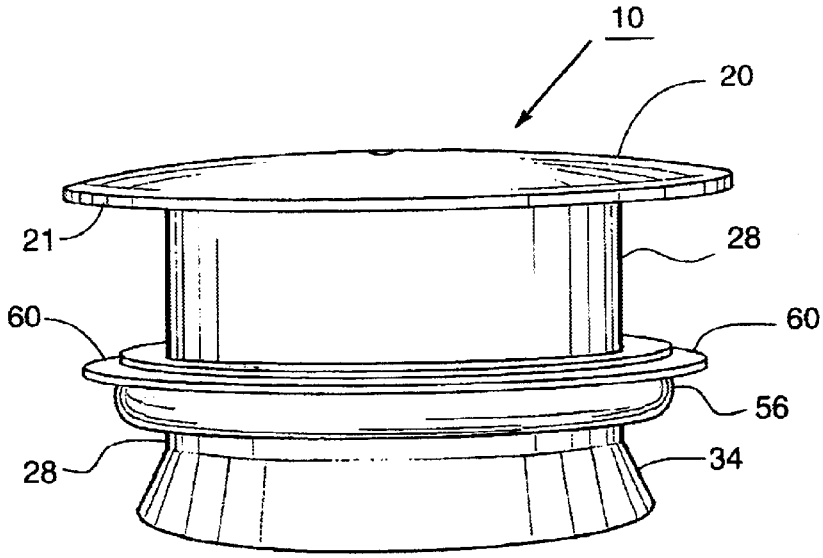
FIG. 5.

COVER APPARATUS FOR AN ACCESS OPENING

BACKGROUND OF THE INVENTION

1. Field of the Invention

This invention relates a cover apparatus for a manhole, pipe or valve, and more particularly to a secure cover for manhole, pipe or valve cover utilizing an expandable bladder that fits around the outer circumference of the depending side wall of the cover. The expandable bladder, provides a secure seal between the cover and the access opening. An externally flared side wall extends below the depending side wall, to improve the seal between the expandable bladder and the access opening.

2. Description of the Prior Art

Water, sewer and electrical wiring is typically buried under public right of way, such as streets, alleys and easements. Access openings are spaced at intervals throughout the system of pipes. The access openings with normally open valves are incorporated for the purpose of selectively isolating sections of the pipe in the event of a break or leak in the system. Shut off valves are frequently buried several feet below the street. Access pipes extend upward from the buried valve to the surface to provide a passage for a tool to selectively actuate the valve between on and off positions. A mechanical cover assembly having a removable cover has traditionally been used to prevent debris from entering the access pipe. The cover assembly typically includes a cast iron cover with a mechanical locking apparatus to secure the cover to a concrete casting which supports the cover.

Drain and water lines are usually installed before the road or site grading begin. Manhole access holes to sewer systems are also placed in public rights of way, and are spaced at intervals throughout the system. Drainage gates are used to drain parking areas and other large surface areas. Drainage gates use slotted covers, and are also connected to the sewer system.

What is needed is a temporary cover that will easily conform to the rough and often unfinished surface of the concrete manhole vault. The temporary cover will stop dirt from being pushed into the sewer line during grading or road construction. Currently, large steel plates are placed over these manhole vaults, and are later removed when the final cast and ring setting work is complete. Steel plates provide a poor fit, and do not stop vandals from intruding into the sewer line during construction. Valve access covers are disclosed in the following prior art:

U.S. Pat. No. 6,109,822 issuing to Campbell et al. on Aug. 29, 2000 discloses a valve access cover assembly having an annular resilient flap.

U.S. Pat. No. 6,073,792 issuing to Campbell et al. on Jun. 13, 2000 discloses an access cap having a movable retaining tongue engageable with a portion of an access structure to retain the cap on the structure.

U.S. Pat. No. 5,439,130 issuing to Waugh on Aug. 8, 1995 discloses a debris cap with a locking post that is insertable into an opening in the closure of the cap.

U.S. Pat. 4,921,123 issuing to Mizioch on May 1, 1990 discloses a debris cap for closing the end of an access pipe for an underground water shut-off valve.

Pipe plugs are disclosed in the following prior art:

U.S. Pat. No. 6,289,935 issuing to Tash on Sep. 18, 2001 discloses a drainpipe test plug to seal a pressurized drainpipe.

U.S. Pat. 6,116,286 issuing to Hooper et al. on Sep. 12, 2000 discloses a pneumatic pipe plug for pipeline tee connections, having a molded cap structure. The air flow regulator extends above the cap, which makes the air flow regulator easy to vandalize.

Manhole covers are disclosed in the following prior art:

U.S. Pat. No. 6,199,414 issuing to Chang on Mar. 13, 2001 discloses a quick release lock for a manhole cover having a radially extended flange. This patent requires slots and catch elements mounted to the cover.

U.S. Pat. No. 5,987,824 issuing to Fuller on Nov. 23, 1999 discloses a locking manhole cover having pivotal locking elements hingedly attached to the frame, and movable locking members biased by interacting cam or gear arrangements.

U.S. Pat. 5,979,117 issuing to Fuller on Nov. 9, 1999 discloses a safety hole cover for drilled and augured holes, with retractable fingers which extend outwardly to engage the side wall of the hole. A tool is inserted through an aperture in the top cap to rotate the fingers.

U.S. Pat. 5,533,641 issuing to Argandona on Jul. 9, 1996 discloses a locking cover assembly with locking levers and a lock actuator movable through the cover.

U.S. Pat. 5,052,851 issuing to Frishauf on Oct. 1, 1991 discloses an emergency maintenance hole cover with an inflatable balloon having a cross-web and a valve extending above the hole.

These prior art patents do not solve the need for a temporary cover that will seal an unfinished opening during construction.

SUMMARY OF THE INVENTION

A cover apparatus for temporarily covering access openings for water, drain, manhole and overflow pipes during construction, when the access openings are exposed, to prevent dirt, dust or unauthorized access to the access openings. The cover apparatus includes an arcuate top portion which extends beyond the outer circumference of the access opening, a depending side wall and an outwardly flared lower side wall extending below the depending side wall, which fits within the access opening, which A central ring depends from the top portion in spaced relation from the depending side wall, and a plurality of ribs extending between the central ring and the depending side wall. A pump means is secured within the central ring, and an expandable bladder in fluid communication with the pump means is positioned about the depending side wall, between the top portion and the outwardly flared side wall. When inflated, the expandable bladder expands to seal the cover apparatus to the access opening. An annular ring may be used to position the expandable bladder on the depending side wall between the annular ring and the outwardly flared side wall, for deeper penetration in the access opening.

Therefore, what is needed is a temporary man hole cover that is inexpensive, light weight, and easy to install or remove.

Another object is an inflatable bladder for an access opening, which expands to seal and retain the cover apparatus against the access opening.

Another object is positioning an outwardly inclined flange beneath the inflatable bladder to direct the bladder into a firm engagement with the access opening.

These objects of the invention, together with the various features of novelty which characterize the invention, are pointed out in the claims. For a better understanding of this invention, its operating advantages and the specific objects attained by its users, reference should be made to the accompanying drawings and descriptive matter in which there is illustrated the preferred embodiments of this invention.

BRIEF DESCRIPTION OF THE DRAWING

FIG. 4 is a perspective view of an alternate configuration of the cover apparatus, shown from the bottom side, prior to installation of a bladder.

FIG. 5 is a side view of an alternate configuration of the cover apparatus, as shown in FIG. 4, with the bladder installed.

The same reference numerals refer to the same parts through the various Figures.

DESCRIPTION OF THE PREFERRED EMBODIMENT OF THE INVENTION

Figure 1:
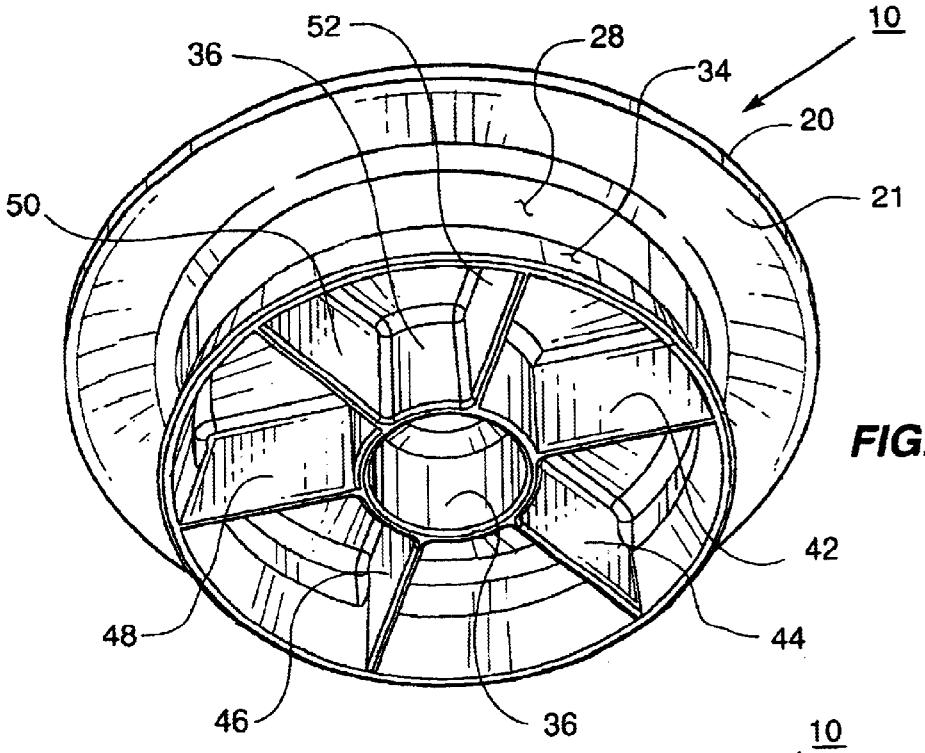
FIG. 1 is a perspective view of the cover apparatus, shown from the bottom side, prior to installation of the bladder.

As shown in FIG. 1, the cover apparatus 10 has an arcuate top portion 20 having an outer circumference 22 greater than the outer circumference 24 of the access opening 26. A sidewall 28 depends from the top portion 20. The sidewall 28 has an outer circumference 30 smaller than the inner circumference 32 of the access opening 26. The depending sidewall 28 extends below the inner circumference 32 of the access opening 26, to an outwardly flared lower side wall 34, which is sized to be smaller than the inner circumference 32 of the access opening 26. This enables the depending side wall 28 and the outwardly flared lower side wall 34 to be slidably received within the inner circumference 32 of the access opening 26.

A central ring 36 depends from the top portion 20, in spaced relation about the central axis 37 of the cover 10. The central ring 36 has an internal pump recess 38 sized to receive a pump means 40 therein. A plurality of ribs 42–52 extend between the central ring 36 and the depending sidewall 28. The ribs 42, 52 further depend between the central ring 36 and the outwardly flared lower sidewall 34. While six ribs 42–52 are shown in FIG. 1, it is within the scope of this invention to provide from six to sixteen ribs 42, 52. Preferably, the space between the ribs 42, 52 is filled with a structural foam 54.

The cover 10 is preferably molded with a reinforced plastic material, which offers substantial weight reduction over the steel or cast iron covers in conventional use. The cover apparatus 10 disclosed herein, is intended for use as a temporary cover for an access opening 26 during road repair and construction. The cover apparatus 10 is suitable for use with both unfinished, as well as for use with finished manhole covers.

Municipalities usually bury their water and sewer main feeder pipes under public right of way, such as streets, alleys, and easements. Access openings 26 are spaced at intervals throughout the pipe system. The access openings are used to isolate sections of the pipe in the event of a break or leak in the pipe system. Shutoff valves (not shown) are positioned adjacent to these access openings 26, to enable a worker to access a selected shutoff valve with a tool from the surface. Shutoff valves are typically installed several feet below ground. When these access openings 26 are left uncovered, they tend to accumulate debris during the construction process, and pose a threat to people and vehicles in proximity to the access opening 26. Large flat steel plates (not shown) are sometimes used to cover access openings 26 during construction. These plates are difficult to handle and position, and do not stop dirt, dust and other objects from entering the access opening beneath the steel plates, when the steel plates are not precisely aligned with the top of the access opening 26. Misaligned steel plates may form a safety hazard for vehicles passing over them, and do not stop vandals from removing the steel plates.

Figure 2:
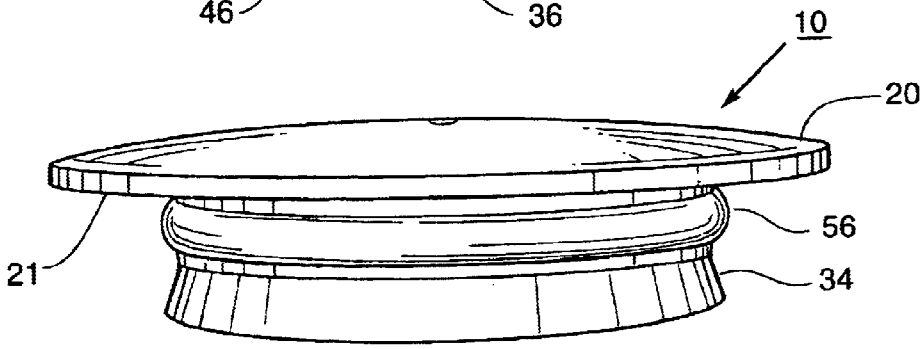
FIG. 2 is a side view of the cover apparatus, with the bladder installed.
Figure 3:
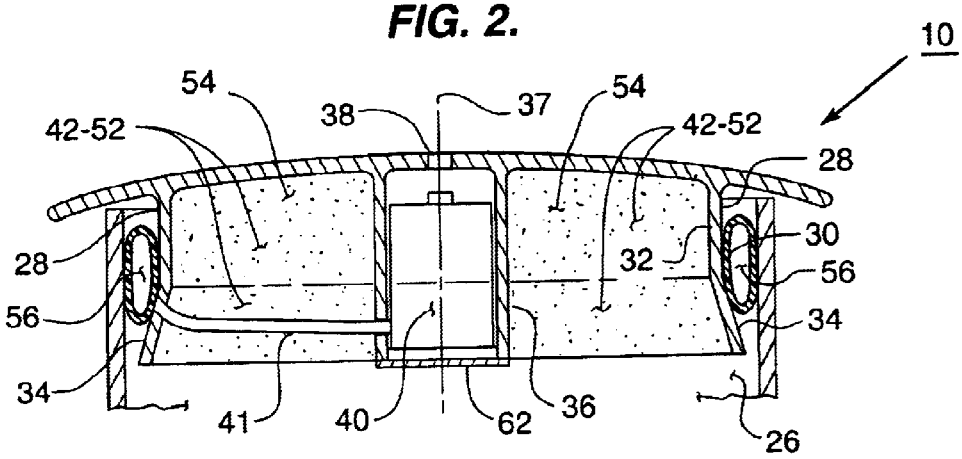
FIG. 3 is a cross-sectional view of the cover apparatus, showing the bladder installed within an access opening.
Figure 6:
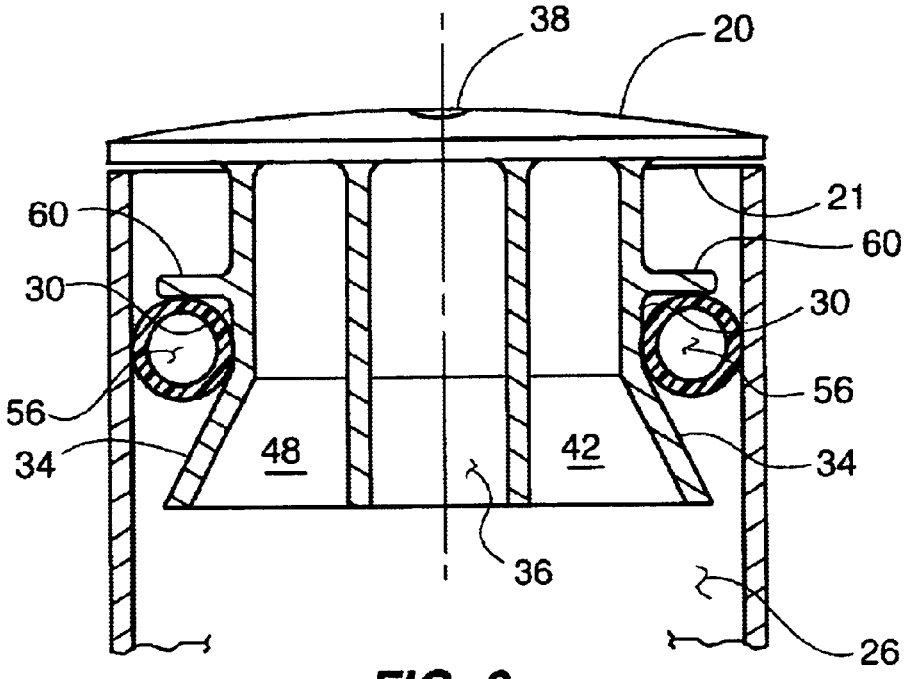
FIG. 6 is a cross sectional view of the cover apparatus shown in FIG. 4, with the bladder expanded to engage the inner side wall of a pipe.
Figure 7:
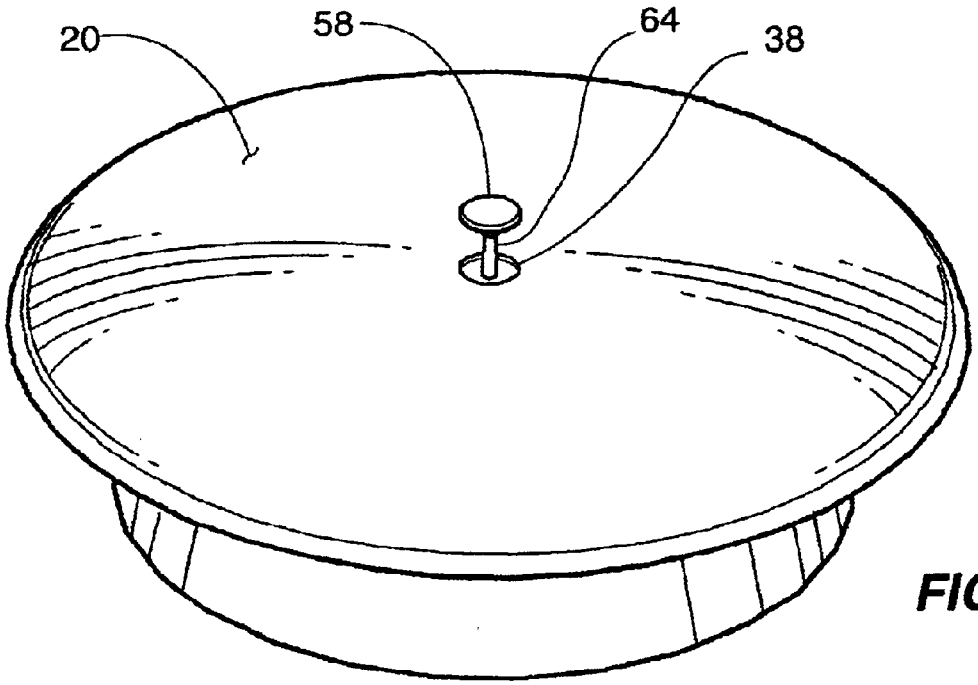
FIG. 7 is a top view of the cover apparatus, showing the pump handle access opening.

FIG. 2 is a side view of the cover apparatus 10, showing an expandible bladder 56 installed about the outer circumference 22 of the depending side wall 28. FIG. 3 is a cross sectional view of the cover apparatus 10, showing the expandible bladder 56 extended to abut the access opening 26. The expandible bladder 56 is in fluid communication with the pump means 40 by a conduit 41, so that when actuated, the pump means 40 fills the expandible bladder 56 which exerts pressure against the access opening 26 and the outer circumference 22 of the depending side wall 28. The pump means 40 may be manually, electrically, pneumatically or hydraulically actuated, by any known pump means 40, to suit manufacturing preference.

A pump handle access opening 38 extends through the top portion 20 of the cover apparatus 10 into the central ring to provide access for a pump handle 58 therein, for actuation of the pump means 40. The pump handle 58 may be removable, or may include an extendable pump rod 64, which is normally retracted, and held in place with a conventional bayonet connection and spring (not shown) for easy release and use. A removable base plate 62 may be used to secure the pump means 40 into the central chamber 35 located within the central ring 36. The base plate 62 is removable to provide access to the pump means 40 for ease of repair or replacement.

Alternately, an external pump means 40, such as a portable, or truck mounted air compressor may be used to inflate the expandable bladder 56. In this embodiment, a conventional inflation valve, (not shown), such as found on bicycle or automobile tires, may be used. Access to the inflation valve would be through the pump handle access opening 38.

When the expandable bladder 56 is filled with a fluid, such as air, water, or a hydraulic fluid, the fluid exerts equal pressure in all directions within the expandable bladder 56. However, since the outwardly flared side wall restricts downward movement of the expandable bladder 56, the expandable bladder 56 expands in the direction of least resistance towards the inner circumference of the access opening 26. This ensures that the expandable bladder 56 remains in place to seal the access opening, when expanded. When the pressure in the expandable bladder 56 is released, the cover 10 is easily removed from the access opening 26.

FIG. 4 is a perspective view of an alternate embodiment of the cover apparatus 10 disclosed above. In this embodiment, an annular ring 60 extends in right angle spaced relation from the depending side wall 28 between the top portion 20 and the outwardly flared side wall 34. This places the expandable bladder 56 lower in the access opening 26, enabling a user to seal an access opening 26 buried beneath the surface. In this embodiment, the expandable bladder 56 is positioned between the annular ring 60 and the outwardly flared side wall 34.

Thus, the preferred invention disclosed herein, is adapted for use with access openings 26 of various diameters and depths, even when the top portion 34 of the access opening 26 is positioned beneath the surface.

Other modifications of this cover apparatus 10 will become apparent to those skilled in the art from an examination of the patent specifications referenced above, when taken in conjunction with the drawings. Therefore, other variations of the present invention may be made which fall within the scope of the following claims.

INDUSTRIAL APPLICABILITY

The cover apparatus disclosed herein is applicable for covering various sizes of access openings, and is particularly useful for temporary use during construction of streets, sewers, and drains. The cover apparatus 10 disclosed herein is lightweight, and adaptable for use on a variety of access openings, from unfinished pipe to manhole openings.

What is claimed is:

1. A cover apparatus to releasably secure an exposed access opening on a pipe or a manhole opening, which comprises:

a) a top portion which extends beyond the outer circumference of the access opening and which has a central axis;

b) a depending side wall portion which depends from the top portion, the side wall portion sized to be less than the inner diameter of the access opening;

c) an outwardly flared lower side wall extending from the lower portion of the depending side wall, the outwardly flared side wall sized to be less than the inner diameter of the access opening, and greater than the depending side wall;

d) a central ring depending from the top portion, the central ring centered on the central axis of the top portion;

e) a plurality of ribs extending between the central ring and the depending side wall;

f) an expandable bladder positioned on the depending side wall between the top portion and the outwardly flared lower side wall;

g) a pump means secured within the central ring of the cover apparatus, the pump means in fluid communication with the expandable bladder;

h) and an actuating means to selectively actuate the pump means to selectively expand and contract the expandable bladder.

2. The cover apparatus of claim 1, wherein the top portion, the depending side wall portion, the central ring portion and the rib portions of the cover apparatus are molded as a single piece of a structural plastic material.

3. The cover apparatus of claim 1, wherein the inflatable bladder is expanded and contracted with one of: air, hydraulic fluid, or water.

4. The cover apparatus of claim 1, wherein the space between the central ring, the ribs and the side wall are filled with a structural foam material.

5. The cover apparatus of claim 1, wherein the pump means is externally actuated from above the cover apparatus, to selectively expand and contract the expandable bladder.

6. The cover apparatus of claim 1, wherein an annular ring extends at a right angle to the depending side wall in spaced relation between the top portion of the cover apparatus and the outwardly flared lower side wall, and the expandable bladder is positioned on the depending side wall between the annular ring and the outwardly flared lower side wall.

7. The cover apparatus of claim 1, wherein the outwardly flared lower side wall is inclined from six degrees to 45 degrees in relation to the depending side wall.

8. The cover apparatus of claim 1, wherein the top portion of the cover apparatus is rounded to form a convex surface for increased strength and rigidity, and a pump handle access opening extends through the top portion of the cover to access the pump means.

9. The cover apparatus of claim 1, wherein the cover apparatus is from five and one-half inches to 40 inches in outer diameter, and extends from two and one-half inches to 12 inches deep.

10. A cover apparatus to releasably secure an access opening on a pipe, a tube or a manhole opening, which comprises:

a) an arcuate top portion which extends beyond the outer circumference of the access opening, and the arcuate top portion of the cover apparatus is rounded to form a convex surface for increased strength and rigidity;

b) a depending side wall which depends from the top portion, the side wall portion sized to be less than the inner diameter of the access opening;

c) an outwardly flared lower side wall extending from the lower portion of the depending side wall, the outwardly flared side wall sized to be less than the inner diameter of the access opening, and greater than the depending side wall;

d) a central ring depending from the arcuate top portion, the central ring centered about the central axis of the top cover, a pump handle access opening extending through the top portion of the cover apparatus into the central ring;

e) a plurality of ribs extending between the central ring and the depending side wall, and the space between the central ring, the ribs and the side wall are preferably filled with a structural foam material;

f) an expandable bladder positioned on the depending side wall between the top portion and the outwardly flared lower side wall;

g) a pump means secured within the central ring of the cover apparatus, the pump means in fluid communication with the expandable bladder;

h) and an actuating means to selectively actuate the pump means to selectively expand and contract the expandable bladder.

11. The cover apparatus of claim 10, wherein the top portion, the depending side wall portion, the central ring portion and the rib portions of the cover apparatus are molded as a single piece of a structural plastic material.

12. The cover apparatus of claim 10, wherein the inflatable bladder is selectively expanded and contracted with one of: air, hydraulic fluid, or water.

13. The cover apparatus of claim 10, wherein the pump means is externally actuated through the pump handle access opening from above the cover apparatus, to selectively expand and contract the expandable bladder.

14. The cover apparatus of claim 10, wherein an annular ring extends at a right angle to the depending side wall in spaced relation between the top portion of the cover apparatus and the outwardly flared lower side wall, and the expandable bladder is positioned on the depending side wall between the annular ring and the outwardly flared lower side wall.

15. The cover apparatus of claim 10, wherein the outwardly flared lower side wall is inclined from six degrees to 45 degrees in relation to the depending side wall.

16. The cover apparatus of claim 10, wherein the cover apparatus is from five and one-half inches to 40 inches in outer diameter, and from two and one-half inches to 12 inches deep.

17. A cover apparatus to releasably secure an access opening on a pipe, a tube or a manhole opening, which comprises:

a) a top portion which extends beyond the outer circumference of the access opening, and the top portion of the cover apparatus is rounded to form an arcuate, convex surface for increased strength and rigidity;

b) a depending side wall which depends from the top portion, the depending side wall of an outer diameter sized to be less than the inner diameter of the access opening;

c) an outwardly flared lower side wall extending from the lower portion of the depending side wall, the outwardly flared side wall sized to be less than the inner diameter of the access opening, and greater than the depending side wall;

d) an annular ring extends at a right angle to the depending side wall in spaced relation between the top portion of the cover apparatus and the outwardly flared lower side wall;

e) a central ring depending from the top portion, the central ring centered about the central axis of the top cover, a pump handle access opening extending through the top portion of the cover apparatus into the central ring;

f) a plurality of ribs extending between the central ring and the depending side wall, and the space between the central ring, the ribs and the side wall are filled with a structural foam material;

g) an expandable bladder positioned on depending side wall between the annular ring and the outwardly flared lower side wall;

h) a pump means secured within the central ring of the cover apparatus, the pump means in fluid communication with the expandable bladder;

i) and an actuating means to selectively actuate the pump means through the pump handle access opening to selectively expand and contract the expandable bladder.

18. The cover apparatus of claim 17, wherein the top portion, the depending side wall portion, the central ring portion and the rib portions of the cover apparatus are molded as a single piece of structural plastic material.

19. The cover apparatus of claim 17, wherein the pump means is externally actuated from above the cover apparatus through the pump handle access opening, to selectively expand and contract the expandable bladder.

20. The cover apparatus of claim 17, wherein the outwardly flared lower side wall is inclined from six degrees to 45 degrees in relation to the depending side wall.

* * * * *